US011249424B2

(12) United States Patent
Furuya et al.

(10) Patent No.: US 11,249,424 B2
(45) Date of Patent: Feb. 15, 2022

(54) IMAGING SYSTEM

(71) Applicant: HEWLETT-PACKARD DEVELOPMENT COMPANY, L.P., Spring, TX (US)

(72) Inventors: Satoru Furuya, Yokohama (JP); Shun Ikeura, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/295,387

(22) PCT Filed: Jan. 6, 2020

(86) PCT No.: PCT/US2020/012360
§ 371 (c)(1),
(2) Date: May 19, 2021

(87) PCT Pub. No.: WO2020/146255
PCT Pub. Date: Jul. 16, 2020

(65) Prior Publication Data

US 2021/0389697 A1 Dec. 16, 2021

(30) Foreign Application Priority Data

Jan. 11, 2019 (JP) ..... JP2019-003572

(51) Int. Cl.
*G03G 15/01* (2006.01)
*G03G 15/16* (2006.01)

(52) U.S. Cl.
CPC ..... *G03G 15/161* (2013.01); *G03G 15/162* (2013.01); *G03G 15/1605* (2013.01)

(58) Field of Classification Search
CPC ..... G03G 15/1605; G03G 15/162; G03G 15/165; G03G 15/1625; G03G 15/1685
USPC ..... 399/302
See application file for complete search history.

(56) References Cited

U.S. PATENT DOCUMENTS

| | | | | |
|---|---|---|---|---|
| 7,215,914 | B2 * | 5/2007 | Murakami et al. | G03G 15/1665 399/299 |
| 7,389,076 | B2 | 6/2008 | Shin et al. | |
| 8,588,666 | B2 * | 11/2013 | Hagari | G03G 15/0194 399/302 |
| 9,594,322 | B2 | 3/2017 | Amemori et al. | |
| 11,131,946 | B2 * | 9/2021 | Ikeda et al. | G03G 15/162 |
| 2003/0235439 | A1 | 12/2003 | Nishida et al. | |
| 2007/0172748 | A1 | 7/2007 | Inoue et al. | |
| 2007/0217832 | A1 | 9/2007 | Oyama et al. | |
| 2008/0038647 | A1 | 2/2008 | Teshima et al. | |

FOREIGN PATENT DOCUMENTS

| | | |
|---|---|---|
| JP | 2003091133 | 3/2003 |
| JP | 2005091612 | 4/2005 |
| JP | 2007093682 | 4/2007 |
| JP | 2009063768 | 3/2009 |

* cited by examiner

*Primary Examiner* — William J Royer
(74) *Attorney, Agent, or Firm* — Staas & Halsey LLP

(57) ABSTRACT

An imaging system includes an image carrier to carry a toner image, and a transfer medium having a transfer surface to receive the toner image from the image carrier. The transfer surface of the transfer medium has a resistance component of 14.6 to 17.7 log Ω·cm for an alternating current having a frequency range of 1 mHz to 1 Hz.

15 Claims, 4 Drawing Sheets

IMAGING SYSTEM

CROSS REFERENCE TO RELATED APPLICATIONS

This application is filed under 35 U.S.C. § 371 as a National Stage of PCT International Application No. PCT/US2020/012360, filed on Jan. 6, 2020, in the U.S. Patent and Trademark Office, which claims the priority benefit of Japanese Patent Application No. 2019-003572, filed on Jan. 11, 2019, in the Japanese Intellectual Property Office. The disclosures of PCT International Application No. PCT/US2020/012360 and Japanese Patent Application No. 2019-003572 are incorporated by reference herein in their entireties.

BACKGROUND

In some imaging systems, an endless belt is used as an intermediate transfer belt for secondarily transferring toner. The endless belt is pressed against an image carrier by a pressing roller.

DETAILED DESCRIPTION

In the following description, with reference to the drawings, the same reference numbers are assigned to the same components or to similar components having the same function, and overlapping description is omitted.

In the following description, an imaging system may be an image forming apparatus such as a printer or a part (for example, a belt driving device) of an image forming apparatus or the like.

Overall Configuration of Example Image Forming Apparatus

Figure 1:
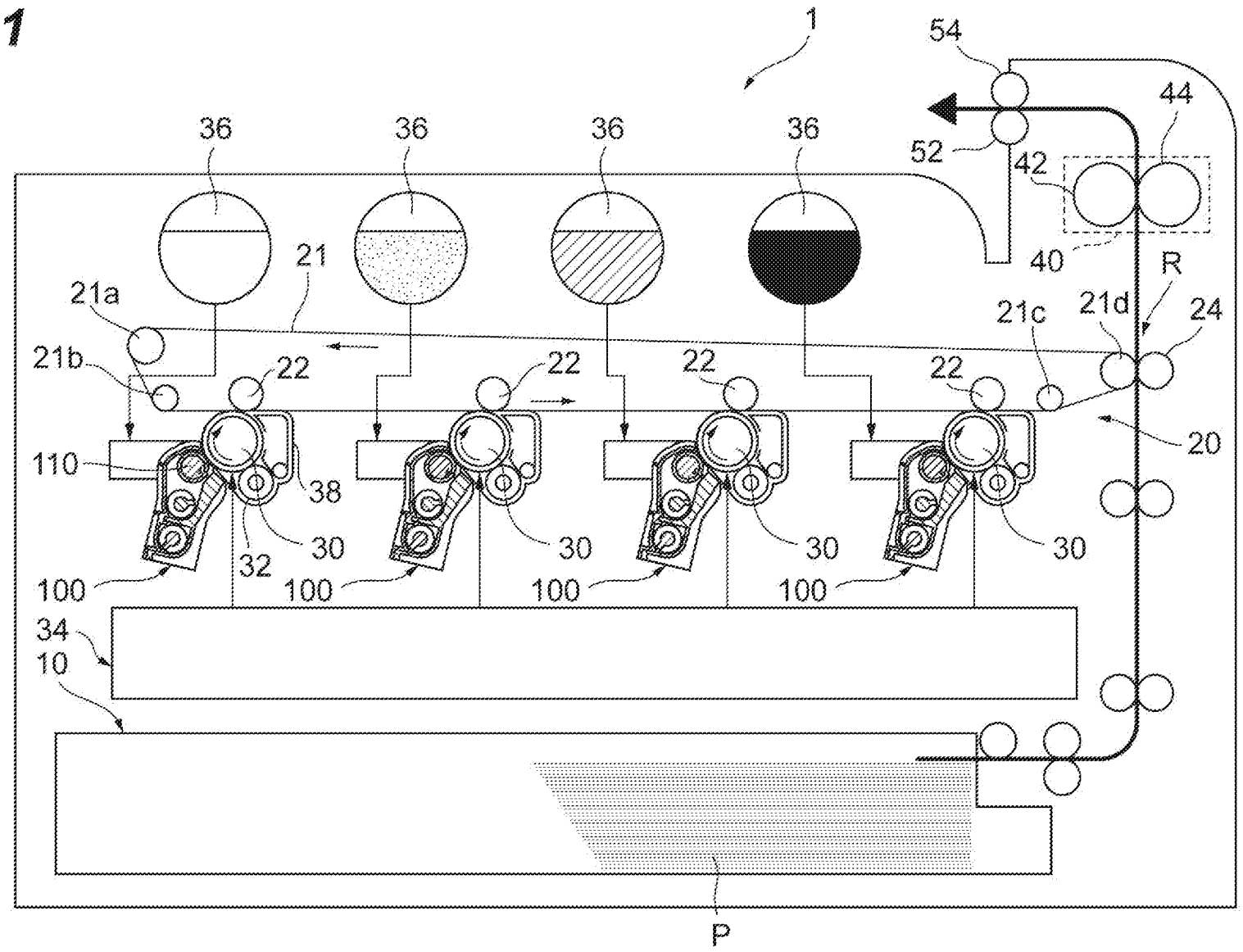
FIG. 1 is a schematic diagram of an example image forming apparatus.

As illustrated in FIG. 1, an example image forming apparatus 1 includes, for example, a recording medium conveying device 10, a transfer device 20, a photosensitive drum 30, four developing devices 100, and a fixing device 40.

The recording medium conveying device 10 accommodates paper sheets P which are recording media on which an image is formed finally. Further, the recording medium conveying device 10 conveys the paper sheet P onto a recording medium conveying path. The paper sheets P are stacked in a cassette. The recording medium conveying device 10 allows the paper sheet P to reach a secondary transfer region R at a timing at which a toner image transferred to the paper sheet P reaches the secondary transfer region R.

The transfer device 20 conveys a toner image formed by the photosensitive drum (the image carrier) 30 to the secondary transfer region R where the toner image is secondarily transferred onto the paper sheet P. The transfer device 20 includes, for example, a transfer belt (a transfer medium and an endless belt) 21, tension rollers 21*a*, 21*b*, 21*c*, and 21*d* which tension the transfer belt 21, a primary transfer roller (a pressing roller) 22 which sandwiches the transfer belt 21 between the primary transfer roller 22 and the photosensitive drum 30, and a secondary transfer roller 24 which sandwiches the transfer belt 21 between the secondary transfer roller 24 and the tension roller 21*d*. The transfer belt 21 is an endless belt which is moved in a circulating manner by the tension rollers 21*a*, 21*b*, 21*c*, and 21*d*. The primary transfer roller 22 is provided to press the photosensitive drum 30 from the inner peripheral side of the transfer belt 21. The secondary transfer roller 24 is provided to press the tension roller 21*d* from the outer peripheral side of the transfer belt 21. Further, the transfer device 20 may include a belt cleaning device or the like which removes toner attached to the transfer belt 21.

The photosensitive drum 30 is an electrostatic latent image carrier which has a peripheral surface to carry a toner image on the peripheral surface. The photosensitive drum 30 may be, for example, an Organic Photo Conductor (OPC). The example image forming apparatus 1 is an apparatus capable of forming a color image. In the example image forming apparatus 1, for example, four photosensitive drums 30 are provided along the movement direction of the transfer belt 21 so as to correspond to respective colors of yellow, magenta, cyan, and black. As illustrated in FIG. 1, a charging roller 32, an exposure device 34, the developing device 100, and a cleaning device 38 may be provided on the periphery of each photosensitive drum 30.

The charging roller 32 uniformly charges a surface of the photosensitive drum 30 to a predetermined potential. The exposure device 34 exposes the surface of the photosensitive drum 30 charged by the charging roller 32 in response to an image formed on the paper sheet P. Accordingly, a potential of a portion exposed by the exposure device 34 in the surface of the photosensitive drum 30 changes, so that an electrostatic latent image is formed. Toner is supplied from toner tanks 36 respectively corresponding to four developing devices 100. Each developing device 100 generates a toner image by developing the electrostatic latent image formed on the photosensitive drum 30 by the toner. Four toner tanks 36 are respectively provided with, for example, a replenishment developer in which toners of yellow, magenta, cyan, and black and carrier are mixed.

The cleaning device 38 collects the toner remaining on the photosensitive drum 30 after the toner image on the photosensitive drum 30 is primarily transferred onto the transfer belt 21. For example, the cleaning device 38 may be configured to remove the remaining toner on the photosensitive drum 30 by allowing a cleaning blade to contact the peripheral surface of the photosensitive drum 30. Furthermore, a charge removal lamp which resets a potential of the photosensitive drum 30 may be disposed between the cleaning device 38 and the charging roller 32 in the rotation direction of the photosensitive drum 30 on the periphery of the photosensitive drum 30.

The fixing device 40 fixes to the paper sheet P, the toner image having been secondarily transferred from the transfer belt 21 onto the paper sheet P. The fixing device 40 includes, for example, a heating roller 42 and a pressing roller 44. The heating roller 42 is a cylindrical member that is rotatable about a rotation shaft. For example, a heat source such as a halogen lamp is provided inside the heating roller 42. The pressing roller 44 is a cylindrical member that is rotatable about a rotation shaft. The pressing roller 44 is provided to press the heating roller 42. The outer peripheral surfaces of the heating roller 42 and the pressing roller 44 are provided with, for example, a heat-resistant elastic layer of silicon rubber or the like. The paper sheet P passes through a fixing nip portion which is a contact region between the heating roller 42 and the pressing roller 44 so that the toner image is melted and fixed to the paper sheet P.

Further, the image forming apparatus 1 may be provided with discharge rollers 52 and 54 which discharge the paper sheet P to which the toner image is fixed by the fixing device 40 to the outside of the image forming apparatus 1.

An example operation of the example image forming apparatus 1 will be described. When an image signal of a printing target image is input to the image forming apparatus 1, a control device of the image forming apparatus 1 uniformly charges the surface of the photosensitive drum 30 to a predetermined potential by the charging roller 32. The control device of the image forming apparatus 1 forms an electrostatic latent image by controlling the exposure device 34 to irradiate a laser beam on the surface of the photosensitive drum 30, based on the received image signal.

The developing device 100 adjusts toner and carrier to a selected mixing ratio while mixing toner and carrier. The developing device 100 adjusts a developer so as to apply an optimal charged amount by uniformly dispersing the toner. The adjusted developer is carried on a developing roller 110. Then, when the developer is conveyed to a region facing the photosensitive drum 30 by the rotation of the developing roller 110, the toner of the developer carried on the developing roller 110 moves to the electrostatic latent image formed on the peripheral surface of the photosensitive drum 30, so that the electrostatic latent image is developed. The toner image which is formed in this way is primarily transferred from the photosensitive drum 30 to the transfer belt 21 in a region in which the photosensitive drum 30 faces the transfer belt 21. The toner images formed on four photosensitive drums 30 are sequentially superimposed (or layered) on the transfer belt 21, so that a single composite toner image is formed. Then, the composite toner image may be secondarily transferred to the paper sheet P conveyed from the recording medium conveying device 10 in the secondary transfer region R in which the tension roller 21*d* faces the secondary transfer roller 24.

The paper sheet P onto which the composite toner image is secondarily transferred is conveyed to the fixing device 40. The paper sheet P is conveyed to pass between the heating roller 42 and the pressing roller 44 while a heat and a pressure are applied thereto so that the composite toner image is melted and fixed to the paper sheet P. Then, the paper sheet P is discharged to the outside of the image forming apparatus 1 by the discharge rollers 52 and 54. When the belt cleaning device is provided, the toner remaining on the transfer belt 21 after the composite toner image is secondarily transferred onto the paper sheet P is removed by the belt cleaning device.

Detail of Configuration of Example Transfer Unit

Figure 2:
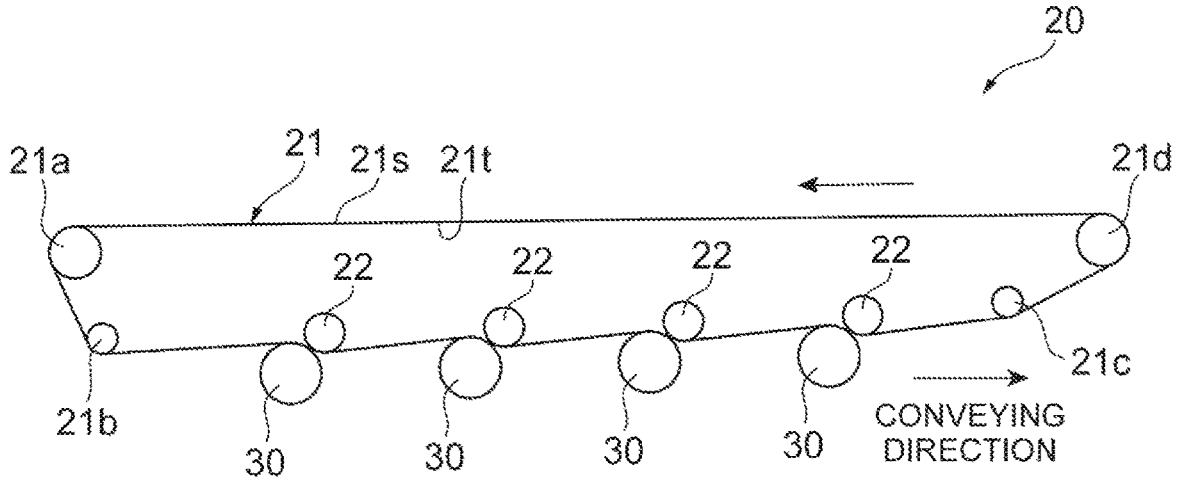
FIG. 2 is a schematic diagram of an example transfer device of the example image forming apparatus of FIG. 1.

With reference to FIG. 2, an example transfer device 20 includes a transfer belt 21. The transfer belt 21 is an annular member that includes an inner peripheral surface 21*t* and an outer peripheral surface 21*s* which is opposite to the inner peripheral surface 21*t*. The outer peripheral surface 21*s* of the transfer belt 21 becomes a transfer surface onto which a toner image is transferred from the photosensitive drum 30. The transfer belt 21 is moved in a circulating manner in the conveying direction (the process direction) indicated by an arrow in FIG. 2 by the tension rollers 21*a*, 21*b*, 21*c*, and 21*d*. That is, the transfer belt 21 is conveyed along the conveying direction of the toner image transferred onto the outer peripheral surface 21*s* (the transfer surface) by the photosensitive drum 30.

Figure 3:
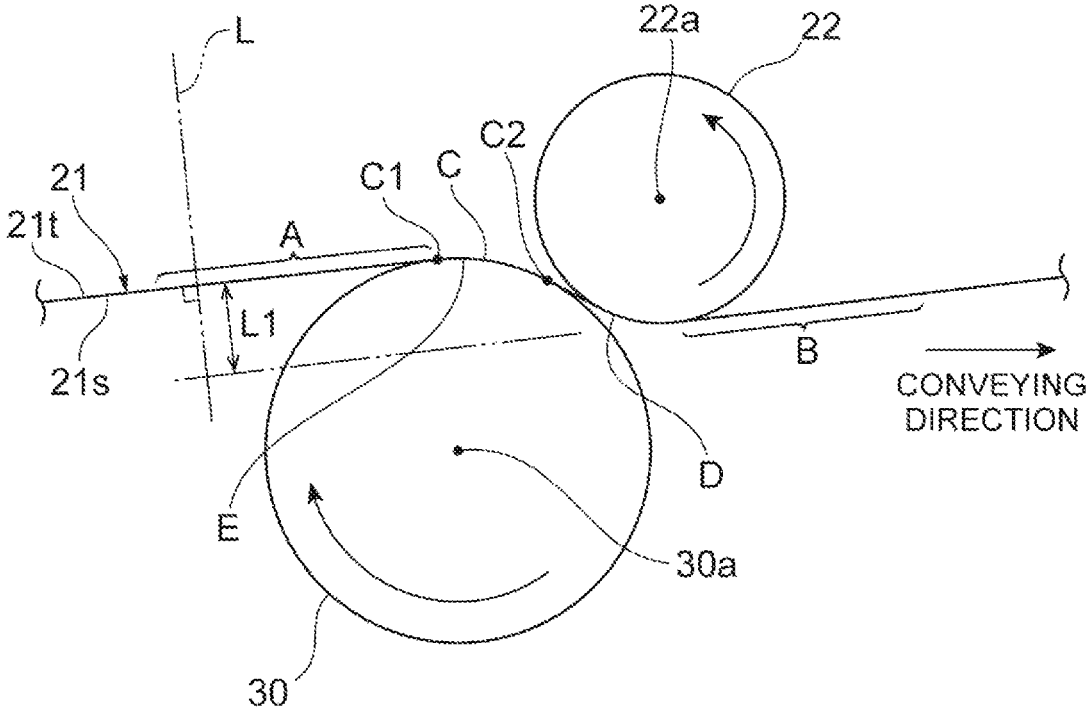
FIG. 3 is a schematic diagram of a photosensitive drum of the example image forming apparatus of FIG. 1.

With reference to FIG. 3, the photosensitive drum 30 is rotated about a rotation shaft 30*a* in accordance with the movement of the transfer belt 21. The primary transfer roller 22 presses the transfer belt 21 from the inner peripheral side of the transfer belt 21 so that the outer peripheral surface 21*s* of the transfer belt 21 is pressed against the outer peripheral surface of the photosensitive drum 30. The primary transfer roller 22 includes a rotation shaft 22*a* and rotates about the rotation shaft 22*a* in accordance with the movement of the transfer belt 21. The rotation shaft 22*a* of the primary transfer roller 22 is located at the downstream side of the conveying direction of the transfer belt 21 in relation to the rotation shaft 30*a* of the photosensitive drum 30.

Given that the rotation shaft 22*a* of the primary transfer roller 22 is offset to the downstream side of the conveying direction in relation to the rotation shaft 30*a* of the photosensitive drum 30, a discharge phenomenon by which an electric field is transferred from the photosensitive drum 30 to the primary transfer roller 22 in a pre-nip region, is prevented. Accordingly, a reverse charge of the toner on the photosensitive drum 30 can be prevented, a reverse transfer rate in the photosensitive drum 30 and the photosensitive drum 30 at the downstream side in the conveying direction can be improved.

With reference to FIG. 3, the transfer belt 21 may include a first linear portion A which is adjacent to the upstream side of the photosensitive drum 30 (the upstream side of the conveying direction) and a second linear portion B which is adjacent to the downstream side of the primary transfer roller 22 (the downstream side of the conveying direction) in a state in which the transfer belt 21 is pressed against the photosensitive drum 30 by the primary transfer roller 22. A direction orthogonal to the first linear portion A of the transfer belt 21 when viewed along the rotation shaft 30*a* of the photosensitive drum 30 (a state illustrated in FIG. 3) is referred to as an L direction. The second linear portion B may be offset with respect to the first linear portion A by a length L1 in the L direction. That is, the first linear portion A and the second linear portion B may be displaced from each other by the length L1 in the L direction.

The transfer belt 21 may include a non-linear portion C which is provided between the first linear portion A and the second linear portion B to be conveyed along the surface of the photosensitive drum 30. The non-linear portion C is curved along the surface of the photosensitive drum 30 and covers the outer peripheral surface of the photosensitive drum 30. For example, a length of the non-linear portion C in the conveying direction of the transfer belt 21 may be greater than 2.5 mm and less than 5 mm.

At an upstream end portion C1 of the non-linear portion C in the conveying direction, the transfer belt 21 does not contact the primary transfer roller 22, but the transfer belt 21 contacts the photosensitive drum 30. At a downstream end portion C2 of the non-linear portion C in the conveying direction, the transfer belt 21 and the photosensitive drum 30 do not contact each other. Further, the downstream end portion C2 of the non-linear portion C in the conveying direction is located at the upstream side of the conveying direction in relation to a position (a contact position D) in which the transfer belt 21 and the primary transfer roller 22 contact each other.

The transfer belt 21 includes the first linear portion A at the upstream side of the photosensitive drum 30 (the upstream side of the conveying direction). The primary transfer roller 22 contacts the transfer belt 21 at the contact portion D of the transfer belt 21. The contact portion D of the transfer belt 21 may be offset from the first linear portion A of the transfer belt 21 in the L direction when viewed along the rotation shaft 30*a* of the photosensitive drum 30 (a state illustrated in FIG. 3). For example, the first linear portion A may be spaced away from the contact portion D in the L direction.

A portion which is pressed against the outer peripheral surface of the photosensitive drum 30 in the transfer belt 21 is referred to as a pressing portion E. The contact portion D of the transfer belt 21 is offset from the first linear portion A of the transfer belt 21 toward the rotation shaft 30*a* of the photosensitive drum 30 in the L direction so that the pressing portion E of the transfer belt 21 contacts the photosensitive drum 30 along the curved surface of the photosensitive drum 30.

Accordingly, since the outer peripheral surface 21*s* of the transfer belt 21 contacts the outer peripheral surface of the photosensitive drum 30, a contact region between the transfer belt 21 and the photosensitive drum 30 is widened. Accordingly, a normal transfer time on the photosensitive drum 30 can be increased, to improve positive transferability. In addition, since a charge is injected to the toner within a region in which the transfer belt 21 contacts the surface of the photosensitive drum 30 so that a negative charge of the toner increases, a reverse transfer rate of the toner on the photosensitive drum 30 and the downstream side of the photosensitive drum 30 in the conveying direction decreases.

Further, a resistance component [log Ω·cm] (the electrical resistivity component) in a frequency range of an alternating current of 1 mHz or more and 1 Hz or less of the transfer belt 21 may be greater than 14.6 [log Ω·cm] and less than 17.7 [log Ω·cm]. For example, the volume resistivity of the transfer belt 21 may tend to decrease as the content of electron conductive substance such as carbon black and ion conductive substance such as lithium perchlorate increases.

The transfer belt 21 may have a two-layer structure. That is, the transfer belt 21 may include a first layer which includes the outer peripheral surface 21*s* and a second layer which is adjacent to the first layer and includes the inner peripheral surface 21*t*. The thickness of the first layer may be greater than 1 μm and less than 20 μm. In this case, the resistance component [log Ω·cm] in a frequency range of an alternating current of 1 mHz or more and 1 Hz or less of the transfer belt 21 may be greater than 14.6 and less than 17.7. Further, the resistance component [log Ω·cm] in a frequency range of an alternating current of 1 Hz or more and 1 kHz or less of the transfer belt 21 may be less than the resistance component in a frequency range of an alternating current of 1 mHz or more and 1 Hz or less. Furthermore, the transfer belt 21 is not limited to have a two-layer structure, but may have a structure of three or more layers.

Method of Forming Transfer Belt 21

A method of forming the transfer belt 21 of a two-layer structure will be described. Hereinafter, a layer (a second layer) at the side of the inner peripheral surface 21*t* is referred to as a base layer and a layer (a first layer) at the side of the outer peripheral surface 21*s* is referred to as a coating layer.

To form a base layer, a resin such as thermosetting and thermoplastic resins may be used. For example, polyamide imide, polyimide, polyether ether ketone, polyphenylene sulfide, and/or polyester may be used, for improved high strength and high durability. This resin may be single or a blended or alloyed mixture and is selected according to a selected property such as mechanical strength.

A conductive agent, such as an electron conductive substance or an ion conductive substance may be used. An electron conductive substance may include carbon black, antimony-doped tin oxide, titanium oxide, and/or a conductive polymer. The ion conductive substance may include sodium perchlorate, lithium, cationic or anionic ionic surfactant, nonionic surfactant, oligomer having an oxyalkylene repeating unit, and/or a polymer compound.

To form the base layer, for example, in the case of using a thermosetting resin such as polyamide imide, carbon black corresponding to a conductive agent is dispersed in a solvent of polyamic acid to make varnish. The varnish is coated using a centrifugal molding device or the like, and dried for at least 10 minutes and not more than 60 minutes, for example, at a temperature of 80° C. or more and 200° C. or less. Then, a seamless belt base layer is formed through a baking process (imidization) at, for example, 250° C. to 450° C. for 20 minutes to 60 minutes. The film thickness of the belt may be 30 μm or more and 150 μm or less.

When the content of carbon black is 20 parts by weight, the resistance component [log Ω·cm] (the electrical resistivity component) in a frequency range of an alternating current of 1 Hz or more and 1 kHz or less of the transfer belt 21 becomes 11.7 [log Ω·cm].

To form a coating layer, a resin may be used. The resin may include, for example, compounds having a curable functional group such as acrylics, phenols, melamines, alkyds, silicones, epoxys, urethanes, and unsaturated polystyrenes or chain polymerization compounds having unsaturated double bonds such as vinyl ethers, vinyls, styrenes, and/or acrylics. One or more of these may be mixed. The above-described substances can be used as a conductive agent.

In the case of forming a coating layer, for example, a coating solution for a coating layer in which a conductive substance is dispersed in the above-described reactive compound is spray-coated on a base layer to form a coating film and is primarily dried for 30 minutes in an oven of 30° C. Then, for example, a curing treatment is performed by irradiating a cumulative light quantity of 2000 mJ/cm$^2$ with a mercury lamp having an ultraviolet intensity of 1 kW/cm$^2$ and drying is performed to complete the formation of the coating layer after the amount of a volatile substance reaches a specified amount or less.

A substance of the coating solution for the coating layer is exemplified. For example, the coating solution for the coating layer may be prepared by mixing and stirring 100 parts by weight of dipentaerythritol hexaacrylate (KAYARAD DPHA: manufactured by Nippon Kayaku Co., Ltd.), 1 part by weight of 1-hydroxycyclohexyl phenyl ketone (Irgacure 184: manufactured by BASF), carbon black (MA100: manufactured by Mitsubishi Chemical Corporation), 1 part by weight of reactive silicone oil (X-22-170DX: manufactured by Shin-Etsu Silicones), and 500 parts by weight of methyl isobutyl ketone.

For example, when the content of carbon black of a coating solution for a coating layer is 10 parts by weight, the resistance component [log Ω·cm] (the electrical resistivity component) of in a frequency range of an alternating current of 1 mHz or more and 1 Hz or less of the transfer belt 21 becomes 17.7 [log Ω·cm]. Further, for example, when the content of carbon black of a coating solution for a coating layer is 40 parts by weight, the resistance component [log Ω·cm] (the electrical resistivity component) in a frequency range of an alternating current of 1 mHz or more and 1 Hz or less of the transfer belt 21 becomes 14.6 [log Ω·cm].

Accordingly, the resistance component [log Ω·cm] in a frequency range of an alternating current of 1 mHz or more and 1 Hz or less of the transfer belt 21 may be greater than 14.6 and less than 17.7. Since this configuration corresponds to a parallel circuit of an electric resistor and a capacitor and the capacitor can maintain the same voltage as the electric resistor, it is possible to keep large electric charges and to increase a toner holding force as the electric resistance increases. Accordingly, the transfer belt 21 can achieve an improved positive transferability of toner. Further, the thickness of the layer including the outer peripheral surface 21*s* may be greater than 1 μm and less than 20 μm, to increase the electrostatic capacity. Accordingly, the toner holding force increases and the positive transferability of the toner can be improved.

Figure 4:
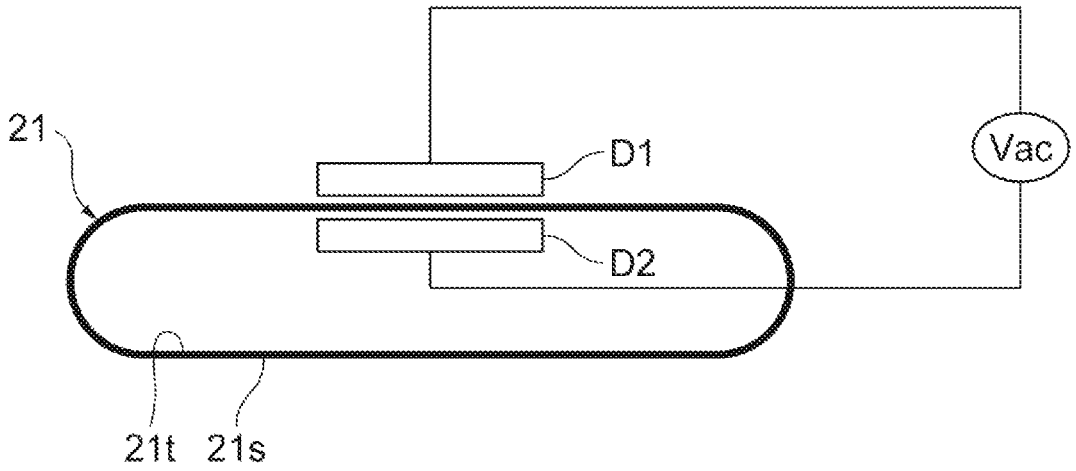
FIG. 4 is a schematic diagram illustrating a method of measuring a resistance component of a transfer belt.

The resistance component measurement method will be described. Here, a case is assumed that the transfer belt 21 has a two-layer structure which includes a first layer with the outer peripheral surface 21*s* and a second layer with the inner peripheral surface 21*t*. For example, the first layer may be a coating layer and the second layer may be a base layer. First, the electrical resistivity of each layer of the transfer belt 21 is measured according to an AC impedance method. For example, as illustrated in FIG. 4, the measurement is performed while changing a frequency at a voltage of 1 v in a state in which the transfer belt 21 is sandwiched by a pair of planar electrodes D1 and D2. The electrical resistivity [Ω] of each layer is derived by the Cole-Cole plot of measurement results. The resistance component ρv [Ω·cm] is derived from the thickness of the transfer belt 21 and the sizes of the planar electrodes D1 and D2. Accordingly, when the measurement is performed by an AC impedance method, the resistance component [log Ω·cm] in a frequency range of an alternating current of 1 mHz or more and 1 Hz or less of the transfer belt 21 may be greater than 14.6 and less than 17.7. Further, the resistance component [log Ω·cm] in a frequency range of an alternating current of 1 Hz or more and 1 kHz or less may be less than the resistance component in a frequency range of an alternating current of 1 mHz or more and 1 Hz or less.

Furthermore, in the description above, a method of measuring the resistance component [log Ω·cm] of the transfer belt 21 having a two-layer structure has been described, but the measurement can be performed similarly to the case of the two-layer structure even when the transfer belt 21 has a structure of three or more layers. Also in a case in which the transfer belt 21 has a structure of three or more layers, the resistance component [log Ω·cm] in a frequency range of an alternating current of 1 mHz or more and 1 Hz or less of the transfer belt 21 may be greater than 14.6 and less than 17.7.

As described above, the example image forming apparatus 1 can suppress a reverse transfer rate by improving a transfer rate of the transfer device 20. Accordingly, the example image forming apparatus 1 can improve image quality and reduce an amount of toner consumed.

It is to be understood that not all aspects, advantages and features described herein may necessarily be achieved by, or included in, any one particular example. Indeed, having described and illustrated various examples herein, it should be apparent that other examples may be modified in arrangement and detail.

For example, in the example image forming apparatus, the primary transfer roller 22 may not be offset to the downstream side of the conveying direction of the transfer belt 21 in relation to the photosensitive drum 30. In this case, the transfer belt 21 may not include a contact portion along the surface of the photosensitive drum 30 as in the non-linear portion C or the pressing portion E.

The invention claimed is:

1. An imaging system comprising:

an image carrier to carry a toner image; and a transfer medium having a transfer surface to receive the toner image from the image carrier, wherein the transfer surface has a resistance component of 14.6 to 17.7 log Ω·cm for an alternating current having a frequency range of 1 mHz to 1 Hz.

2. The imaging system according to claim 1, wherein the transfer medium includes a first layer which includes the transfer surface and a second layer which is adjacent to the first layer, and wherein the transfer medium formed by the first layer and the second layer, is imparted with the resistance component of 14.6 to 17.7 log Ω·cm for the alternating current in the frequency range of 1 mHz to 1 Hz.

3. The imaging system according to claim 2, wherein a layer thickness of the first layer is larger than 1 μm and smaller than 20 μm.

4. The imaging system according to claim 2, wherein a resistance component [log Ω·cm] of the transfer medium for an alternating current having a frequency range of 1 Hz to 1 kHz is less than the resistance component of the transfer medium for the alternating current having a frequency range of 1 mHz to 1 Hz.

5. An imaging system comprising:

an endless belt which includes a transfer surface to convey a toner image in a conveying direction, wherein the transfer surface has a resistance component of 14.6 to 17.7 log Ω·cm for an alternating current having a frequency range of 1 mHz to 1 Hz;

an image carrier to transfer the toner image onto the transfer surface of the endless belt and to rotate about a rotation shaft; and a pressing roller to press the endless belt against the image carrier, wherein the pressing roller includes a rotation shaft located at a downstream side in the conveying direction of the endless belt in relation to the rotation shaft of the image carrier.

6. The imaging system according to claim 5, wherein the endless belt includes a first linear portion adjacent an upstream side of the image carrier, and a second linear portion adjacent a downstream side of the pressing roller, and wherein the second linear portion is offset with respect to the first linear portion in a direction perpendicular to the first linear portion of the endless belt.

7. The imaging system according to claim 6, wherein the endless belt includes a non-linear portion to travel along a surface of the image carrier between the first linear portion and the second linear portion.

8. The imaging system according to claim 7, wherein a length of the non-linear portion along the conveying direction of the endless belt is approximately 2.5 mm to 5 mm.

9. The imaging system according to claim 5, wherein the endless belt includes a linear portion located on an upstream side of the image carrier, wherein the pressing roller contacts the endless belt at a contact portion of the endless belt, and wherein the contact portion of the endless belt is offset from the linear portion of the endless belt in a direction perpendicular to the linear portion.

10. The imaging system according to claim 9, wherein the contact portion of the endless belt is offset from the linear portion of the endless belt in a direction perpendicular to the linear portion, toward the rotation shaft of the image carrier to direct a pressed portion of the endless belt to contact the image carrier along a curved surface of the image carrier.

11. The imaging system according to claim 5, wherein the endless belt includes a first layer which includes the transfer surface and a second layer which is adjacent to the first layer.

12. The imaging system according to claim 11, wherein a layer thickness of the first layer is between approximately 1 μm and 20 μm.

13. The imaging system according to claim 11, wherein a resistance component [log Ω·cm] of the endless belt, for an alternating current having a frequency range of 1 Hz to 1 kHz is less than the resistance component of the endless belt for the alternating current having the frequency range of 1 mHz to 1 Hz.

14. An imaging system comprising:

an endless belt to convey a toner image in a conveying direction;

an image carrier to transfer the toner image onto the endless belt and rotates about a rotation shaft; and a pressing roller to press the endless belt against the image carrier, wherein the pressing roller includes a rotation shaft located at a downstream side of the rotation shaft of the image carrier, in the conveying direction of the endless belt, wherein the endless belt includes a first linear portion adjacent an upstream side of the image carrier and a second linear portion adjacent a downstream side of the pressing roller, and wherein the second linear portion is offset with respect to the first linear portion in a direction perpendicular to the first linear portion of the endless belt.

15. The imaging system according to claim 14, wherein the endless belt includes a non-linear portion to travel along a surface of the image carrier between the first linear portion and the second linear portion.

* * * * *